US010837077B2

(12) United States Patent
Hikida et al.

(10) Patent No.: US 10,837,077 B2
(45) **Date of Patent: *Nov. 17, 2020**

(54) STEEL SHEET AND METHOD FOR PRODUCTION THEREOF

(71) Applicant: NIPPON STEEL & SUMITOMO METAL CORPORATION, Tokyo (JP)

(72) Inventors: Kazuo Hikida, Tokyo (JP); Ken Takata, Tokyo (JP); Kengo Takeda, Tokyo (JP); Motonori Hashimoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 141 days.

This patent is subject to a terminal disclaimer.

(21) Appl. No.: 15/576,653

(22) PCT Filed: May 26, 2016

(86) PCT No.: PCT/JP2016/065630

§ 371 (c)(1),
(2) Date: Nov. 22, 2017

(87) PCT Pub. No.: WO2016/190397

PCT Pub. Date: Dec. 1, 2016

(65) Prior Publication Data

US 2018/0127848 A1 May 10, 2018

(30) Foreign Application Priority Data

May 26, 2015 (JP) ..... 2015-106739

(51) Int. Cl.

| | |
|---|---|
| ***C22C 38/06*** | (2006.01) |
| ***C21D 9/46*** | (2006.01) |
| ***C22C 38/60*** | (2006.01) |
| ***C22C 38/08*** | (2006.01) |
| ***C22C 38/14*** | (2006.01) |
| ***C22C 38/12*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/16*** | (2006.01) |
| ***C22C 38/22*** | (2006.01) |

(Continued)

(52) U.S. Cl.

CPC ..... *C21D 9/46* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/32* (2013.01); *C22C 38/60* (2013.01); *C21D 2211/005* (2013.01); *C21D 2211/009* (2013.01); *C23G 1/00* (2013.01)

(58) Field of Classification Search

CPC ..... C21D 9/46; C21D 6/002; C21D 6/005; C21D 6/008; C21D 8/0205; C21D 8/0226; C21D 8/0263; C21D 2211/005; C21D 2211/009; C22C 38/001; C22C 38/002; C22C 38/008; C22C 38/02; C22C 38/04; C22C 38/06; C22C 38/08; C22C 38/12; C22C 38/14; C22C 38/16; C22C 38/22; C22C 38/24; C22C 38/26; C22C 38/28; C22C 38/32; C22C 38/60; C23G 1/00

USPC ..... 148/602

See application file for complete search history.

(56) References Cited

U.S. PATENT DOCUMENTS 5,178,688 A 1/1993 Yu et al.
6,312,529 B1 11/2001 Leap et al.
(Continued)

FOREIGN PATENT DOCUMENTS

CN 102899564 A 1/2013
CN 103469089 A 12/2013
(Continued)

OTHER PUBLICATIONS

Nakamura. JP2007270331A. Machine translation. Retrieved from google patents.*

(Continued)

*Primary Examiner* — Matthew E. Hoban
(74) *Attorney, Agent, or Firm* — Birch, Stewart, Kolasch & Birch, LLP

(57) ABSTRACT

The present invention provides steel sheet excellent in cold formability and ductility after heat treatment and a method for production thereof. The steel sheet of the present invention is steel sheet which has a chemical composition containing, by mass %, C: 0.10 to 0.40%, Si: 0.30 to 1.00%, Mn: 0.30 to 1.00%, Al: 0.001 to 0.10%, P: 0.0001 to 0.02%, and S: 0.0001 to 0.01% and having a balance of Fe and impurities, which steel sheet characterized in that a ratio (B/A) of the number of carbides at the ferrite grain boundaries (B) to the number of carbides inside the ferrite grains (A) is over 1, a ferrite grain size is 5 μm to 50 μm, an average grain size of carbides is 0.4 μm to 2.0 μm, a pearlite area ratio is 6% or less, and a Vicker's hardness is 120 HV to 170 HV.

6 Claims, No Drawings

(51) Int. Cl.

| | |
|---|---|
| ***C22C 38/24*** | (2006.01) |
| ***C22C 38/26*** | (2006.01) |
| ***C22C 38/28*** | (2006.01) |
| ***C22C 38/32*** | (2006.01) |
| *C23G 1/00* | (2006.01) |

(56) References Cited

U.S. PATENT DOCUMENTS

| | | | | |
|---|---|---|---|---|
| 2003/0098104 | A1* | 5/2003 | Tsuchida | C21D 8/06 148/598 |
| 2003/0196735 | A1* | 10/2003 | Sugiura | C22C 38/02 148/602 |
| 2009/0173415 | A1 | 7/2009 | Seto et al. | |
| 2009/0260729 | A1 | 10/2009 | Iizuka et al. | |
| 2009/0308504 | A1 | 12/2009 | Kariya et al. | |
| 2010/0282376 | A1* | 11/2010 | Kimura | B21B 3/00 148/602 |
| 2015/0298211 | A1 | 10/2015 | Abe et al. | |
| 2016/0145710 | A1 | 5/2016 | Miyamoto et al. | |
| 2018/0105891 | A1 | 4/2018 | Hikida et al. | |
| 2018/0127848 | A1 | 5/2018 | Hikida et al. | |
| 2018/0135146 | A1 | 5/2018 | Takata et al. | |
| 2018/0171445 | A1 | 6/2018 | Hikida et al. | |
| 2018/0230582 | A1 | 8/2018 | Takeda et al. | |

FOREIGN PATENT DOCUMENTS

| | | | |
|---|---|---|---|
| CN | 103764862 | A | 4/2014 |
| CN | 107250415 | A | 10/2017 |
| CN | 107614728 | A | 1/2018 |
| EP | 3282032 | A1 | 2/2018 |
| JP | 6-116679 | A | 4/1994 |
| JP | 8-120405 | A | 5/1996 |
| JP | 9-201644 | A | 8/1997 |
| JP | 9-316540 | A | 12/1997 |
| JP | 10-158780 | A | 6/1998 |
| JP | 10-204539 | A | 8/1998 |
| JP | 10-265840 | A | 10/1998 |
| JP | 11-61272 | A | 3/1999 |
| JP | 11-80884 | A | 3/1999 |
| JP | 11-269553 | A | 10/1999 |
| JP | H11269552 | * | 10/1999 |
| JP | 2000-328172 | A | 11/2000 |
| JP | 2001-73033 | A | 3/2001 |
| JP | 2001-73076 | A | 3/2001 |
| JP | 2001-73077 | A | 3/2001 |
| JP | 2003-160836 | A | 6/2003 |
| JP | 2004-27355 | A | 1/2004 |
| JP | 2006-213951 | A | 8/2006 |
| JP | 2006-257449 | A | 9/2006 |
| JP | 3879459 | B2 | 2/2007 |
| JP | 3909939 | B2 | 4/2007 |
| JP | 2007-231416 | A | 9/2007 |
| JP | 2007-270324 | A | 10/2007 |
| JP | 2007-270327 | A | 10/2007 |
| JP | 2007-270330 | A | 10/2007 |
| JP | 2007-270331 | A | 10/2007 |
| JP | 2007270331 | * | 10/2007 |
| JP | 2007-291495 | A | 11/2007 |
| JP | 2008-69452 | A | 3/2008 |
| JP | 2008-274416 | A | 11/2008 |
| JP | 2008-303415 | A | 12/2008 |
| JP | 2009-24233 | A | 2/2009 |
| JP | 4319940 | B2 | 8/2009 |
| JP | 2009-263718 | A | 11/2009 |
| JP | 4465057 | B2 | 2/2010 |
| JP | 2010-235977 | A | 10/2010 |
| JP | 2010-280929 | A | 12/2010 |
| JP | 2011-168842 | A | 9/2011 |
| JP | 2012-36497 | A | 2/2012 |
| JP | 2012-52150 | A | 3/2012 |
| JP | 2012-62496 | A | 3/2012 |
| JP | 4974285 | B2 | 4/2012 |
| JP | 2013-40376 | A | 2/2013 |
| JP | 5194454 | B2 | 2/2013 |
| JP | 5197076 | B2 | 2/2013 |
| JP | 2013-127100 | A | 6/2013 |
| JP | 5458649 | A | 4/2014 |
| JP | 2015-17284 | A | 1/2015 |
| JP | 2015-17294 | A | 1/2015 |
| JP | 5660220 | B2 | 1/2015 |
| JP | 2015-117406 | A | 6/2015 |
| JP | 2015-160986 | A | 9/2015 |
| JP | 2015-199987 | A | 11/2015 |
| WO | WO 2007/088985 | A1 | 8/2007 |
| WO | WO 2007/111080 | A1 | 10/2007 |
| WO | WO 2007/116599 | A1 | 10/2007 |
| WO | WO 2013/035848 | A1 | 3/2013 |

OTHER PUBLICATIONS

Suzuki. JPH11269552. Machine Translation. Retrieved from google patents.*

Extended European Search Report dated Nov. 13, 2018, in European Patent Application No. 16800101.4.

N.N.: "Standard Practice for Using Significant Digits in Test Data to Determine Conformance with Specifications," American National Standard, Jan. 1, 2013 (Jan. 1, 2013), XP055297340, West Conshohocken, PA, DOI: 10.1520/E0029-13, Retrieved from the Internet: URL:http://www.galvanizeit.com/uploads/AST M- E-29-yr-13 .pdf [retrieved on Aug. 24, 2016].

English tanslation of Office Action dated Nov. 7, 2018, in Chinese Patent Application No. 201680030147.2.

Chinese Office Action and Search Report for Chinese Application No. 201680030094.4, dated May 8, 2019.

Chinese Office Action and Search Report for Chinese Application No. 201680030094.4, dated Oct. 24, 2018.

Chinese Office Action and Search Report for Chinese Application No. 201680030099.7, dated Oct. 24, 2018.

Chinese Office Action and Search Report for Chinese Application No. 201680035011.0, dated Nov. 16, 2018.

Extended European Search Report for European Application No. 16800100.6, dated Oct. 29, 2018.

Extended European Search Report for European Application No. 16811762.0, dated Oct. 30, 2018.

International Search Report (Form PCT/ISA/210) for International Application No. PCT/JP2016/061608, dated Jul. 12, 2016, with English translation.

International Search Report (Form PCT/ISA/210) for International Application No. PCT/JP2016/065509, dated Aug. 30, 2016.

International Search Report (Form PCT/ISA/210) for International Application No. PCT/JP2016/065629, dated Aug. 30, 2016, with English translation.

International Search Report (Form PCT/ISA/210) for International Application No. PCT/JP2016/068169, dated Jul. 26, 2016.

Korean Office Action for Korean Application No. 10-2017-7033291, dated Jan. 10, 2019, with English translation.

U.S. Office Action for U.S. Appl. No. 15/565,096, dated Aug. 8, 2019.

U.S. Office Action for U.S. Appl. No. 15/576,177, dated Aug. 29, 2019.

Written Opinion of the International Searching Authority (Form PCT/ISA/237) for International Application No. PCT/JP2016/065509, dated Aug. 30, 2016.

Written Opinion of the International Searching Authority (Form PCT/ISA/237) for International Application No. PCT/JP2016/065629, dated Aug. 30, 2016.

Written Opinion of the International Searching Authority (Form PCT/ISA/237) for International Application No. PCT/JP2016/068169, dated Jul. 26, 2016.

U.S. Office Action for U.S. Appl. No. 15/565,096, dated Jan. 23, 2020.

U.S. Office Action for U.S. Appl. No. 15/576,177, dated Jan. 24, 2020.

U.S. Office Action for U.S. Appl. No. 15/736,945, dated Jan. 22, 2020.

(56) References Cited

OTHER PUBLICATIONS

Brazilian Office Action for Brazilian Application No. 112017024692-9, dated Feb. 27, 2020, with partial English translation.
U.S. Office Action for U.S. Appl. No. 15/736,945, dated Apr. 30, 2020.

* cited by examiner

STEEL SHEET AND METHOD FOR PRODUCTION THEREOF

TECHNICAL FIELD

The present invention relates to steel sheet and a method for production thereof.

BACKGROUND ART

Auto parts, edged tools, and other machine parts are produced by stamping, bending, press-forming, and other working processes. In these working processes, to improve and stabilize the product quality and reduce the manufacturing costs, it is necessary to improve the workability of the carbon steel sheet of starting material. In particular, when forming drive system parts, sometimes carbon steel sheet deforms due to high speed rotation etc. or breaks due to insufficient ductility, so ductility after heat treatment becomes necessary.

In general, carbon steel sheet is cold rolled and spheroidally annealed. Carbon steel sheet is used as a soft material with excellent workability comprising ferrite and spheroidized carbides. Further, up to now, several arts have been proposed for improving the workability of carbon steel sheet.

For example, PLT 1 discloses high carbon steel for precision stamping containing C: 0.15 to 0.90 mass %, Si: 0.40 mass % or less, Mn: 0.3 to 1.0 mass %, P: 0.03 mass % or less, total Al: 0.10 mass % or less, Ti: 0.01 to 0.05 mass %, B: 0.0005 to 0.0050 mass %, N: 0.01 mass % or less, and Cr: 1.2 mass % or less, having a microstructure wherein carbides of an average carbide grain size of 0.4 to 1.0 μm and a spheroidization rate of 80% or more are dispersed in a ferrite matrix, and having a notch tensile elongation of 20% or more and a method for production thereof.

PLT 2 discloses a medium and high carbon steel sheet excellent in workability containing C: 0.3 to 1.3 mass %, Si: 1.0 mass % or less, Mn: 0.2 to 1.5 mass %, P: 0.02 mass % or less, and S: 0.02 mass % or less, having a microstructure wherein carbides are carbides so that a relationship of $C_{GB}/C_{IG} \leq 0.8$ stands between the carbides $C_{GB}$ at the ferrite crystal grain boundaries and the number of carbides $C_{IG}$ inside the ferrite crystal grains, and having a cross-sectional hardness of 160 HV or less and a method for production thereof.

PLT 3 discloses medium and high carbon steel sheet excellent in workability containing C: 0.30 to 1.00 mass %, Si: 1.0 mass % or less, Mn: 0.2 to 1.5 mass %, P: 0.02 mass % or less, and S: 0.02 mass % or less and having a microstructure wherein carbides are dispersed in ferrite, and wherein a relationship of $C_{GB}/C_{IG} \leq 0.8$ stands between the carbides $C_{GB}$ at the ferrite crystal grain boundaries and the number of carbides $C_{IG}$ inside the ferrite crystal grains and spheroidized carbides with a long axis/short axis of 2 or less account for 90% or more of all of the carbides.

These prior arts are predicated on the workability becoming better the more the ratio of carbides in the ferrite grains.

PLT 4 discloses steel sheet excellent in FB workability, die life, and formability after FB working characterized by comprising C: 0.1 to 0.5 mass %, Si: 0.5 mass % or less, Mn: 0.2 to 1.5 mass %, P: 0.03 mass % or less, and S: 0.02 mass % or less and having a microstructure mainly comprising ferrite and carbides and by having an amount of ferrite grain boundary carbides $S_{gb}$, defined as $$S_{gb}=(S_{on}/(S_{on}+S_{in}))\times 100$$

(where, $S_{on}$: total occupied area of carbides present at the grain boundaries in the carbides present per unit area and $S_{in}$: total occupied area of carbides present inside the grains in the carbides present per unit area), of 40% or more.

The art described in PLT 5 is characterized by suitably annealing hot rolled steel sheet having a substantially 100% pearlite structure so as to promote spheroidization of the carbides and suppress ferrite grain growth so as to place most of the carbides at the ferrite crystal grain boundaries.

The art described in PLT 6 is characterized in that the microstructure has a main phase of ferrite and a second phase in which martensite fraction is kept low and cementite and other carbides are mainly contained. In addition, the art described in PLT 6 actively utilizes Si to thereby secure strength by solution strengthening of ferrite and secure ductility by improvement of the work hardenability of the ferrite itself.

PLT 7 discloses the art of controlling the ferrite grain size to 10 μm or more to thereby produce soft medium carbon steel sheet excellent in induction hardenability. The method of production disclosed in PLT 7 is characterized by treating the steel by box annealing for heating it to 600° C. to 750° C. to thereby coarsen the ferrite grains of the steel sheet and soften the steel sheet.

The steel sheet disclosed in PLT 8 is characterized in that 10 to 50% of the C content is graphitized and a steel structure in cross-section is a ferrite phase in which spheroidal cementite containing C wt $\% \times 10^2/mm^2$ pieces to C wt $\% \times 10^3/mm^2$ pieces of graphite particles having a size of 3 μm is dispersed. The method of production disclosed in PLT 8 is characterized by annealing the hot rolled steel sheet in a range of 600° C. to 720° C. from the viewpoint of graphitization of the steel sheet.

The steel sheet disclosed in PLT 9 is characterized by having a microstructure containing an area ratio 90% or more bainite phase, wherein a number ratio of Fe-based carbides precipitated in the bainitic ferrite grains in the total Fe-based carbides precipitated in the bainite phase is 30% or more, and an average grain size of Fe-based carbides precipitated in the bainitic ferrite grains is 150 nm or less.

The steel sheet disclosed in PLT 10 is characterized in that in a region from the surface layer of the steel sheet down to 200 μm in the direction of sheet thickness, the density of the crystal orientation where the (110) faces are within ±5 with respect to the steel sheet surface is 2.5 or more.

CITATION LIST

Patent Literature

PLT 1: Japanese Patent No. 4465057
PLT 2: Japanese Patent No. 4974285
PLT 3: Japanese Patent No. 5197076
PLT 4: Japanese Patent No. 5194454
PLT 5: Japanese Patent Publication No. 2007-270330A
PLT 6: Japanese Patent Publication No. 2012-36497A
PLT 7: Japanese Patent Publication No. 2012-62496A
PLT 8: Japanese Patent Publication No. 8-120405A
PLT 9: Japanese Patent Publication No. 2015-160986A
PLT 10: Japanese Patent Publication No. 2015-117406A

SUMMARY OF INVENTION

Technical Problem

The art described in PLT 1 aims at coarsening of the ferrite grain size and carbides and anneals the steel at a temperature of the $A_{C1}$ point or more for softening. However, if annealing at a temperature of the $A_{C1}$ point or more, during annealing, rod-shaped and plate-shaped carbides precipitate. The carbides are said to lower the workability, so even if able to lower the hardness, this acts disadvantageously to workability.

PLTs 2 and 3 both describe that a low spheroidization rate of the carbides precipitating at the grain boundaries (referred to as "grain boundary carbides") is a cause of deterioration of the workability. However, none of the arts described in PLTs 2 and 3 has improvement of the workability by improvement of the spheroidization rate of grain boundary carbides as their problems. In the art described in PLT 4, only structural factors are prescribed. The relationship between workability and mechanical characteristics is not studied.

PLTs 5 to 9 do not specify conditions of the annealing process from the viewpoint of promotion of precipitation of carbides at the ferrite grain boundaries. Further, PLTs 5 to 9 do not specify cooling conditions after the annealing process, so with the methods of production disclosed in PLTs 5 to 9, the austenite produced after annealing is liable to transform to pearlite, the steel sheet to increase in hardness, and the cold formability to fall.

PLT 10 discloses coiling up steel sheet after finish rolling at a 400° C. to less than 650° C. of coiling temperature, then annealing the coiled steel sheet the first time at 680° C. to 720° C. and annealing the coiled steel sheet the second time at 730° C. to 790° C., then, after the second stage annealing, annealing the coiled steel sheet by a 20° C./hr cooling rate from the viewpoint of spheroidization of the cementite. However, in the method of production of PLT 10, the finish rolling is made to end at 600° C. to less than Ae3-20° C., so the steel sheet is liable to be rolled in the dual phase region of ferrite and austenite. For this reason, ferrite phases and pearlite phases are liable to be formed after rolling, the state of dispersion of carbides in the steel sheet after rolling to become uneven, and the hardness of the steel sheet to rise.

In view of the prior art, the technical problem to be solved by the present invention is to improve the cold formability and ductility after heat treatment in steel sheet, and the object of the present invention is to provide steel sheet and a method for production thereof solving this problem.

Here, the "cold formability" means the deformation ability of steel sheet able to easily plastically deform to the required shape without defect when making steel sheet plastically deform to the required shape by cold working, cold forging, etc. Further, the "ductility after heat treatment" is the ductility of the steel sheet after heat treatment.

Solution to Problem

To solve the above problem and obtain steel sheet suitable for a material for a drive system part etc., it can be understood to be sufficient to enlarge the grain size of ferrite in steel sheet having the C required for raising the hardenability, make the carbides (mainly cementite) suitable grain sizes, and reduce the pearlite structures. This is due to the following reasons.

Ferrite phases are low in hardness and high in ductility. Therefore, by increasing the grain size in a microstructure mainly comprising ferrite, it becomes possible to raise the formability of a material.

By dispersing suitably carbides in a metal structure, the formability of the material can be maintained while excellent wear resistance and rolling fatigue characteristics being imparted, so are essential structures for drive system parts. Further, the carbides in steel sheet are strong grains inhibiting slip. By making the carbides be present at the ferrite grain boundaries, propagation of slip crossing the crystal grain boundaries is prevented and formation of a shear zone can be suppressed. The cold forgeability is improved and simultaneously the steel sheet is improved in formability.

However, cementite is a hard and brittle structure. If present in the form of a layered structure with ferrite, that is, pearlite, the steel becomes hard and brittle, so it has to be made present in a spheroidal form. If considering the cold forgeability and the formation of cracks at the time of forging, its grain size has to be made a suitable range.

However, the method of production for realizing the above structure has not been disclosed up to now. Therefore, the inventors engaged in intensive research on the method of production for realizing this structure.

As a result, they discovered that to make the metal structure of the steel sheet after coiling after hot rolling a bainite structure in which cementite is dispersed in fine pearlite or fine ferrite with small lamellar spacing, the steel sheet should be coiled up at a relatively low temperature (400° C. to 550° C.). By coiling at a relatively low temperature, the cementite dispersed in the ferrite also becomes easy to spheroidize. Next, as the first stage annealing, the cementite should be partially spheroidized by annealing at a temperature of right below the Ac1 point. Next, as the second stage annealing, part of the ferrite grains should be left while causing part to transform to austenite by annealing at a temperature between the Ac1 point and the Ac3 point (so-called dual phase region of ferrite and austenite). After that, the steel sheet should be slowly cooled to cause the remaining ferrite grains to grow while these remaining ferrite grains are used as nuclei for transformation of austenite to ferrite. Therefore, large ferrite phases are obtained while cementite is caused to precipitate at the grain boundaries, and the above structure is realized.

That is, they discovered that a method for production of steel sheet simultaneously satisfying hardenability and formability is difficult to realize even if adjusting the hot rolling conditions, annealing conditions, etc. separately, and they discovered that it can be realized by achieving optimization in a so-called "integrated" process comprising hot rolling and annealing etc.

In this way, the inventors found that by optimizing the dispersed state of carbides in the steel sheet structure before cold working steel sheet optimized in chemical composition in coalition with the manufacturing conditions in an integrated process from hot rolling to annealing, it is possible to control the microstructure of the steel sheet and cause suitable grain size carbides to precipitate at the ferrite grain boundaries.

Further, the inventors discovered that if making the ferrite grain size 5 μm or more and making the Vicker's hardness 170 or less, it is possible to secure excellent cold formability and ductility after heat treatment in steel sheet.

The present invention was made based on the above discovery and has as its gist the following:

(1) A steel sheet comprising, by mass %,
C: 0.10 to 0.40%,
Si: 0.30 to 1.00%,
Mn: 0.30 to 1.00%,
Al: 0.001 to 0.10%,
P: 0.02% or less, and
S: 0.01% or less and
having a balance of Fe and impurities,
wherein a ratio (B/A) of a number of carbides at ferrite grain boundaries (B) with respect to a number of carbides inside ferrite grains (A) is over 1,
wherein a ferrite grain size is 5 μm to 50 μm,
wherein an average grain size of carbides is 0.4 μm to 2.0 μm,
wherein a pearlite area ratio is 6% or less, and
wherein a Vicker's hardness is 120 HV to 170 HV.

(2) The steel sheet according to (1), the steel sheet further comprises, by mass %, one or more of:
N: 0.01% or less and
O: 0.02% or less.

(3) The steel sheet according to (1) or (2), wherein the steel sheet further comprises, by mass %, one or more of:
Ti: 0.10%,
Cr: 0.50%,
Mo: 0.50%,
B: 0.01%,
Nb: 0.10%,
V: 0.10%,
Cu: 0.10%,
W: 0.10%,
Ta: 0.10%,
Ni: 0.10%,
Sn: 0.05%,
Sb: 0.05%,
As: 0.05%,
Mg: 0.05%,
Ca: 0.05%,
Y: 0.05%,
Zr: 0.05%,
La: 0.05%, and
Ce: 0.05%.

(4) A method for producing the steel sheet according to any one of (1) to (3), the method for producing the steel sheet comprising:
(i) hot rolling a steel slab of a chemical composition according to any one of (1) to (3) directly or after being cooled temporarily and then being heated; finishing the hot rolling in a temperature range of 800° C. to 900° C.; and coiling the hot rolled steel sheet at 400° C. to 550° C.,
(ii) paying out the hot rolled steel sheet; pickling the hot rolled steel sheet; then holding the hot rolled steel sheet in a temperature range of 650° C. to 720° C. for 3 hours to 60 hours as first stage annealing and further holding the hot rolled steel sheet in a temperature range of 725° C. to 790° C. for 3 hours to 50 hours as second stage annealing,
(iii) cooling the hot rolled steel sheet after annealing, with a cooling rate of 1° C./hour to 30° C./hour, down to 650° C.; and then cooling the hot rolled steel sheet down to room temperature.

(5) The method for producing the steel sheet according to (4), wherein the temperature of the steel slab used for the hot rolling is 1000 to 1250° C.

Advantageous Effects of Invention

According to the present invention, it is possible to provide steel sheet excellent in cold formability and ductility after heat treatment and a method for production thereof. The steel sheet of the present invention has a high ductility after heat treatment and is excellent in sheet formability before heat treatment and can be suitably used for fatigue parts which are subjected to repeated stress, for example, structural parts of the chasses of automobiles.

DESCRIPTION OF EMBODIMENTS

First, the reasons for limitation of the chemical composition of the steel sheet of the present invention are explained. Below, % means mass %.

[C: 0.10 to 0.40%]

C is an element which forms carbides and is effective for strengthening of steel and refinement of ferrite grains. In order to suppress the formation of a textured surface of the steel sheet at the time of cold forming and secure the beautiful appearance of the cold formed product, it is necessary to suppress coarsening of the ferrite grains. If less than 0.10%, the volume fraction of carbides is insufficient and coarsening of the ferrite grains cannot be suppressed during annealing, so C is made 0.10% or more. Preferably it is 0.14% or more. On the other hand, if C is over 0.40%, the volume fraction of carbides increases and the cold formability and ductility after heat treatment fall, so C is made 0.40% or less. Preferably it is 0.38% or less.

[Si: 0.30 to 1.00%]

Si is an element which affects the form of the carbides and contributes to improvement of ductility after heat treatment. To reduce the number of carbides inside the ferrite grains and increase the number of carbides at the ferrite grain boundaries, two-stage step type annealing (below, sometimes called "two-stage annealing") has to be used to form austenite phases during annealing, dissolve the carbides once, gradually cool the steel, then promote the precipitation of carbides at the ferrite grain boundaries.

If Si is less than 0.30%, the effect due to addition is not sufficiently obtained, so Si is made 0.30% or more. Preferably it is 0.35% or more. On the other hand, if over 1.00%, due to solution strengthening by the ferrite, the hardness rises and the cold formability falls, fractures easily occur, and, also, the $A_3$ point rises and the hardening temperature has to be made higher, so Si is made 1.00% or less. Preferably it is 0.90% or less.

[Mn: 0.30 to 1.00%]

Mn is an element controlling the form of carbides in two-stage annealing. If less than 0.30%, in the gradual cooling after two-stage annealing, it becomes difficult to form carbides at the ferrite grain boundaries, so Mn is made 0.30% or more. Preferably it is 0.33% or more. On the other hand, if over 1.00%, the hardness of the ferrite increases and the cold formability falls, so Mn is made 1.00% or less. Preferably it is 0.96% or less.

[Al: 0.001 to 0.10%]

Al is an element acting as a deoxidizing agent and stabilizing ferrite. With less than 0.001%, the effect due to addition is not sufficiently obtained, so Al is made 0.001% or more. Preferably it is 0.004% or more. On the other hand, if over 0.10%, the number of carbides at the ferrite grain boundaries is reduced and the cold formability falls, so Al is made 0.10% or less. Preferably it is 0.09% or less.

[P: 0.02% or Less]

P is an element which segregates at the ferrite grain boundaries and acts to suppress the formation of carbides at the ferrite grain boundaries. For this reason, the content of P is preferably as small as possible. It may also be 0%, but if reducing it to less than 0.0001%, the refining costs greatly increase, so it may be made 0.0001% or more. The content of P may also be made 0.0013% or more. On the other hand, if P is over 0.02%, the formation of carbides at the ferrite grain boundaries is suppressed, the number of carbides is reduced, and the cold formability falls, so P is made 0.02% or less. Preferably it is 0.01% or less.

[S: 0.01% or Less]

S is an element forming MnS and other nonmetallic inclusions. Nonmetallic inclusions become starting points of fracture at the time of cold forming, so S is preferably as small as possible. It may also be 0%, but if reducing it to less than 0.0001%, the refining costs greatly increase, so it may be made 0.0001% or more. The content of S may also be made 0.0012% or more. On the other hand, if over 0.01%, nonmetallic inclusions are formed and the cold formability falls, so S is made 0.01% or less. Preferably it is 0.009% or less.

The steel sheet of the present invention may also contain the following elements in addition to the above elements.

[N: 0.01% or Less]

N is an element causing embrittlement of ferrite if present in a large amount. For this reason, N is preferably as small as possible. The content of N may be made 0 as well, but if reducing it to less than 0.0001%, the refining costs greatly increase, so it may be made 0.0001% or more. The content of N may also be made 0.0006% or more. On the other hand, if over 0.01%, the ferrite becomes brittle and the cold formability falls, so N is made 0.01% or less. Preferably it is 0.007% or less.

[O: 0.02% or Less]

O is an element forming coarse oxides if present in a large amount. For this reason, O is preferably as small as possible. It may also be 0%, but if reducing it to less than 0.0001%, the refining costs greatly increase, so it may be made 0.0001% or more. The content of O may also be made 0.0011% or more. On the other hand, if over 0.02%, coarse oxides are formed in the steel and become starting points of fracture at the time of cold forming, so O is made 0.02% or less. Preferably it is 0.01% or less.

In the steel sheet of the present invention, in addition to the above elements, further, one or more of the following elements may be included. Further, the following elements are not essential for obtaining the effects of the present invention, so the content may also be made 0%.

[Ti: 0.10% or Less]

Ti is an element forming nitrides and contributing to refinement of the crystal grains. With less than 0.001%, the effect of addition is not sufficiently obtained, so Ti preferably is made 0.001% or more. More preferably it is 0.005% or more. On the other hand, if over 0.10%, coarse Ti nitrides are formed and the cold formability falls, so Ti is made 0.10% or less. Preferably it is 0.07% or less.

[Cr: 0.50% or Less]

Cr is an element which contributes to improvement of the hardenability while concentrating at the carbides and stabilizing the carbides to form stable carbides even inside the austenite phases. With less than 0.001%, the effect of improvement of the hardenability is not obtained, so Cr preferably is made 0.001% or more. More preferably it is 0.007% or more. On the other hand, if over 0.50%, stable carbides are formed inside the austenite phases, the dissolution of carbides at the time of hardening becomes slow, and the required hardening strength is not obtained, so Cr is made 0.50% or less. Preferably it is 0.48% or less.

[Mo: 0.50% or Less]

Mo, like Mn, is an element effective for control of the form of carbides. Further, it is an element refining the structure and contributing to improvement of the ductility. With less than 0.001%, the effect due to addition is not obtained, so Mo preferably is made 0.001% or more. More preferably it is 0.017% or more. On the other hand, if over 0.50%, the in-plane anisotropy of the "r" value falls and the cold formability falls, so Mo is made 0.50% or less. Preferably it is 0.45% or less.

[B: 0.01% or Less]

B is an element contributing to improvement of the hardenability. If less than 0.0004%, the effect due to addition is not obtained, so B preferably is made 0.0004% or more. More preferably it is 0.0010% or more. On the other hand, if over 0.01%, coarse B compounds are formed and the cold formability falls, so B is made 0.01% or less. Preferably it is 0.008% or less.

[Nb: 0.10% or Less]

Nb is an element effective for control of the form of carbides. Further, it is an element refining the structure and contributing to improvement of the ductility. With less than 0.001%, the effect due to addition is not obtained, so Nb preferably is made 0.001% or more. More preferably it is 0.002% or more. On the other hand, if over 0.10%, a large number of fine Nb carbides are formed and the strength rises too much. Further, the number of carbides at the ferrite grain boundaries falls and the cold formability falls, so Nb is made 0.10% or less. Preferably it is 0.09% or less.

[V: 0.10% or Less]

V, like Nb, is an element effective for control of the form of carbides. Further, it is an element refining the structure and contributing to improvement of the ductility. With less than 0.001%, the effect due to addition is not obtained, so V preferably is made 0.001% or more. More preferably it is 0.004% or more. On the other hand, if over 0.10%, a large number of fine V carbides are formed and the strength rises too much. Further, the number of carbides at the ferrite grain boundaries falls and the cold formability falls, so V is made 0.10% or less. Preferably it is 0.09% or less.

[Cu: 0.10% or Less]

Cu is an element which segregates at the ferrite grain boundaries. Further, it is an element which forms fine precipitates and contributes to improvement of the strength. With less than 0.001%, the effect of improvement of the strength is not obtained, so Cu preferably is made 0.001% or more. More preferably it is 0.004% or more. On the other hand, if over 0.10%, segregation at the ferrite grain boundaries invites hot-shortness and the productivity in hot rolling falls, so it is made 0.10% or less. Preferably it is 0.09% or less.

[W: 0.10% or Less]

W, like Nb and V, is an element effective for control of the form of the carbides. With less than 0.001%, the effect due to addition is not obtained, so W preferably is made 0.001% or more. More preferably it is 0.003% or more. On the other hand, if over 0.10%, a large number of fine W carbides are formed and the strength rises too much. Also, the number of carbides at the ferrite grain boundaries is reduced and the cold formability falls, so W is made 0.100% or less. Preferably it is 0.08% or less.

[Ta: 0.100% or Less]

Ta also, like Nb, V, and W, is an element effective for control of the form of the carbides. With less than 0.001%, the effect due to addition is not obtained, so Ta preferably is made 0.001% or more. More preferably it is 0.007% or more. On the other hand, if over 0.10%, a large number of fine Ta carbides are formed and the strength rises too much. Also, the number of carbides at the ferrite grain boundaries is reduced and the cold formability falls, so Ta is made 0.10% or less. Preferably it is 0.09% or less.

[Ni: 0.100/or Less]

Ni is an element effective for improvement of ductility. With less than 0.001%, the effect due to addition is not obtained, so Ni preferably is made 0.001% or more. More preferably it is 0.002% or more. On the other hand, if over 0.10%, the number of carbides at the ferrite grain boundaries is reduced and the cold formability falls, so Ni is made 0.10% or less. Preferably it is 0.09% or less.

[Sn: 0.05% or Less]

Sn is an element which unavoidably enters from the steel starting materials. For this reason, Sn is preferably as small as possible. It may also be 0%/a, but if reducing it to less than 0.001%, the refining costs greatly increase, so Sn may be made 0.001% or more. The content of Sn may be made 0.002% or more. On the other hand, if over 0.05%, the ferrite becomes brittle and the cold formability falls, so Sn is made 0.05% or less. Preferably it is 0.04% or less.

[Sb: 0.05% or Less]

Sb, like Sn, is an element which unavoidably enters from the steel starting materials, segregates at the ferrite grain boundaries, and reduces the number of carbides at the ferrite grain boundaries. For this reason, Sb is preferably as small as possible. It may also be 0%. However, if reducing it to less than 0.001%, the refining costs greatly increase, so Sb may be made 0.001% or more. The content of Sb may be made 0.002% or more. On the other hand, if over 0.05%, Sb segregates at the ferrite grain boundaries, the number of carbides at the ferrite grain boundaries is reduced, and the cold formability falls, so Sb is made 0.05% or less. Preferably it is 0.04% or less.

[As: 0.05% or Less]

As element, like Sn and Sb, is an element which unavoidably enters from the steel starting materials and segregates at the ferrite grain boundaries. For this reason, the As element is preferably as small as possible. It may also be 0%/a. However, if reducing it to less than 0.001%, the refining costs greatly increase, so As may be made 0.001% or more. Preferably it may be made 0.002% or more. On the other hand, if over 0.05%, the As elements segregate at the ferrite grain boundaries, the number of carbides at ferrite grain boundaries is reduced, and the cold formability falls, so As is made 0.05% or less. Preferably it is 0.04% or less.

[Mg: 0.05% or Less]

Mg is an element able to control the form of sulfides by addition in a trace amount. With less than 0.0001%, the effect due to addition is not obtained, so Mg preferably is made 0.0001% or more. More preferably it is 0.0008% or more. On the other hand, if over 0.05%, the ferrite becomes brittle and the cold formability falls, so Mg is made 0.05% or less. Preferably it is 0.04% or less.

[Ca: 0.05% or Less]

Ca, like Mg, is an element able to control the form of sulfides by addition in a trace amount. With less than 0.001%, the effect due to addition is not obtained, so Ca preferably is made 0.001% or more. More preferably it is 0.003% or more. On the other hand, if over 0.05%, coarse Ca oxides are formed and become starting points of fracture at the time of cold forming, so Ca is made 0.05% or less. Preferably it is 0.04% or less.

[Y: 0.05% or Less]

Y, like Mg and Ca, is an element able to control the form of sulfides by addition in a trace amount. With less than 0.001%, the effect due to addition is not obtained, so Y preferably is made 0.001% or more. More preferably it is 0.003% or more. On the other hand, if over 0.05%, coarse Y oxides are formed and become starting points of fracture at the time of cold forming, so Y is made 0.05% or less. Preferably it is 0.03% or less.

[Zr: 0.05% or Less]

Zr, like Mg, Ca, and Y, is an element able to control the form of sulfides by addition in a trace amount. With less than 0.001%, the effect due to addition is not obtained, so Zr preferably is made 0.001% or more. More preferably it is 0.004% or more. On the other hand, if over 0.05%, coarse Zr oxides are formed and become starting points of fracture at the time of cold forming, so Zr is made 0.05% or less. Preferably it is 0.04% or less.

[La: 0.05% or Less]

La is an element able to control the form of sulfides by addition in a trace amount, but is also an element which segregates at the ferrite grain boundaries and reduces the number of carbides at the ferrite grain boundaries. With less than 0.001%, the effect of control of the form of sulfides is not obtained, so La preferably is made 0.001% or more. More preferably it is 0.003% or more. On the other hand, if over 0.05%, it segregates at the ferrite grain boundaries, the number of carbides at the ferrite grain boundaries is reduced, and the cold formability falls, so La is made 0.05% or less. Preferably it is 0.04% or less.

[Ce: 0.05% or Less]

Ce, like La, is an element able to control the form of sulfides by addition in a trace amount, but it is also an element which segregates at the ferrite grain boundaries and reduces the number of carbides at the ferrite grain boundaries. With less than 0.001%, the effect of control of the form of sulfides is not obtained, so Ce preferably is made 0.001% or more. More preferably it is 0.003% or more. On the other hand, if over 0.05%, it segregates at the ferrite grain boundaries, the number of carbides at the ferrite grain boundaries is reduced, and the cold formability falls, so Ce is made 0.05% or less. Preferably it is 0.04% or less.

Note that, in the steel sheet of the present invention, the balance of the chemical composition comprises Fe and unavoidable impurities.

In the steel sheet of the present invention, in addition to the above chemical composition, (a) the ratio (B/A) of the number of carbides at the ferrite grain boundaries (B) to the number of carbides inside the ferrite grains (A) is over 1, (b) the ferrite grain size is 5 μm to 50 μm, (c) the average grain size of carbides is 0.4 μm to 2.0 μm, (d) the pearlite area ratio is 6% or less, and (e) the Vicker's hardness is 120 HV to 170 HV as characterizing requirements.

The steel sheet of the present invention has excellent cold formability and ductility after heat treatment by being provided with not only the above chemical composition but also the above characterizing requirements (a) to (e). This is a novel finding discovered by the inventors. This will be explained below.

[Characterizing Requirement (a)]

The structure of the steel sheet of the present invention is a structure substantially consisting of ferrite and carbides. Further, it is made a structure where the ratio (B)/(A) of the number of carbides at the ferrite grain boundaries (B) to the number of carbides inside the ferrite grains (A) is over 1.

Note that, carbides include not only the cementite ($Fe_3C$) of the compound of iron and carbon but also compounds where the Fe atoms in cementite are replaced by Mn, Cr, and other alloy elements and alloy carbides ($M_{23}C_6$, $M_6C$, MC, etc. [where M: Fe, and other metal elements added as alloys]).

When shaping steel sheet into a predetermined form, a shear zone is formed in the macrostructure of the steel sheet and slip deformation occurs concentratedly near the shear zone. Slip deformation is accompanied with proliferation of dislocations. Near the shear zone, a region of high dislocation density is formed. Along with the increase of the amount of strain imparted to the steel sheet, slip deformation is promoted and the dislocation density increases. To improve cold formability, it is effective to suppress formation of a shear zone.

From the viewpoint of the microstructure, the formation of a shear zone is understood as the phenomenon of slip occurring at a certain single crystal grain crossing crystal grain boundaries and continuously propagating to the adjoining crystal grains. Accordingly, to suppress formation of a shear zone, it is necessary to prevent propagation of slip crossing crystal grain boundaries. Carbides in steel sheet are strong grains inhibiting slip. By forming carbides at the ferrite grain boundaries, propagation of slip crossing crystal grain boundaries can be prevented and formation of a shear zone can be suppressed so the cold formability can be improved.

Based on theory and principle, cold formability is considered to be strongly affected by the coverage rate of the ferrite grain boundaries by carbides. High precision measurement is sought. However, measurement of the coverage rate of ferrite grain boundaries by carbides in a three-dimensional space requires serial sectioning SEM observation which repeatedly conducts cutting a sample using an FIB and observing the cut sample in a scan type electron microscope or 3D EBSP observation. A massive measurement time is required and technical knowhow has to be built up.

The inventors did not adopt the above observation technique because of considering it not to be a general analysis technique and searched for a simpler, higher precision indicator for evaluation. As a result, they discovered that if using the ratio (B/A) of the number of carbides at the ferrite grain boundaries (B) to the number of carbides inside the ferrite grains (A) as the indicator, it would be possible to quantitatively evaluate the cold formability and that if that ratio (B/A) is over 1, the cold formability remarkably rises.

Buckling, folding, and twisting of the steel sheet occurring at the time of cold forging occur due to localization of strain accompanying the formation of a shear zone, so by forming carbides at the ferrite grain boundaries, formation of a shear zone and localization of strain are eased and occurrence of buckling, folding, and twisting is suppressed.

[Characterizing Requirement (b)]

By making the ferrite grain size in the structure of the annealed steel sheet 5 μm or more, it is possible to improve the cold formability. If the ferrite grain size is less than 5 μm, the hardness increases and fractures or cracks easily form at the time of cold forming, so the ferrite grain size is made 5 μm or more. Preferably it is 7 μm or more. On the other hand, if the ferrite grain size is over 50 μm, the number of carbides at the crystal grain boundaries suppressing propagation of slip is reduced and the cold formability falls, so the ferrite grain size is made 50 μm or less. Preferably it is 38 μm or less.

[Characterizing Requirement (c)]

If the average grain size of carbides contained in the structure of the steel sheet of the present invention is less than 0.4 μm, the steel sheet remarkably increases in hardness and the cold formability falls, so the average grain size of carbides is made 0.4 μm or more. Preferably it is 0.6 μm or more. On the other hand, if the average grain size of carbides contained in the structure of the steel sheet of the present invention is over 2.0 μm, at the time of cold forming, the carbides form the starting points of cracks, so the average grain size of carbides is made 2.0 μm or less. Preferably it is 1.95 μm or less.

[Characterizing Requirement (d)]

If the pearlite area ratio is over 6%, the steel sheet remarkably increases in hardness and the cold formability falls, so the pearlite area ratio is made 6% or less. Preferably it is 5% or less.

[Characterizing Requirement (e)]

By making the Vicker's hardness of the steel sheet 120 HV to 170 HV, the cold formability can be improved. If the Vicker's hardness is less than 120 HV, at the time of cold forming, buckling easily occurs, so the Vicker's hardness is made 120 HV or more. Preferably it is 130 HV or more. On the other hand, if the Vicker's hardness is over 170 HV, the ductility falls and inner fracture easily occurs at the time of cold forming, so the Vicker's hardness is made 170 HV or less. Preferably it is 160 HV or less.

Next, the methods of observation and measurement of the structure will be explained.

The carbides are observed by a scan type electron microscope. Before observation, the sample for observation of the structure is polished by chemical polishing using Emery paper and a diamond abrasive having an average particle size of 1 μm, the observed surface is polished to a mirror finish, then a 3% nitric acid-alcohol solution is used to etch the structure. For the magnification of the observation, magnification enabling judgment of the structure of ferrite and carbides is selected among 3000×. Images of a plurality of fields of 30 μm×40 μm at a sheet thickness ¼ layer are captured at random by the selected magnification. For example, images of eight or more regions which do not overlap each other are captured.

The obtained structural images are used for measuring area of the carbides. From the area of the carbides, the circle equivalent diameter ($=2\times\sqrt{(\text{area}/3.14)}$) is found. The average value is made the carbide grain size. For measurement of the areas of the carbides, image analyzing software (for example, Win ROOF produced by Mitani Shoji) may be used to measure in detail the areas of the carbides contained in the analysis region. Note that to suppress the enlargement of the measurement error due to noise, carbides with an area of 0.01 $\mu m^2$ or less are excluded from coverage by the evaluation.

Using the above-mentioned structural images, the number of carbides present at the ferrite grain boundaries is counted and the number of carbides at the ferrite grain boundaries is subtracted from the total number of carbides to calculate the number of carbides inside the ferrite grains. Based on the counted and calculated numbers of carbides, the ratio (B/A) of the number of carbides at the ferrite grain boundaries (B) to the number of carbides inside the ferrite grains (A) is calculated. Further, carbides with an area of 0.01 $\mu m^2$ or less are not counted.

After polishing the surface of the sample to be observed to a mirror finish by using the above-mentioned procedure and then etching the surface of the sample by using a 3% nitric acid-alcohol solution, the ferrite grain size can be measured by observing the etched structure by using an optical microscope or scan type electron microscope and applying the line method to the captured image.

Next, the method for production of the present invention is explained.

The method for production of the present invention is characterized by managing cooperatively the conditions in the hot rolling process, the conditions in the coiling process and the conditions in the two-stage annealing process in an integrated fashion to control the structure of the steel sheet.

A steel slab obtained by continuously casting molten steel of the required chemical composition is hot-rolled directly or is hot-rolled after being cooled once and then being heated. The finish rolling of the hot rolling is completed in the temperature range of 800° C. to 900° C. By hot rolling the steel slab in the above-mentioned manner, it is possible to obtain a steel sheet structure consisting of fine pearlite and bainite.

The hot rolled steel sheet finished being finish rolled is coiled up in a temperature range of 400° C. to 550° C. The coiled hot rolled steel sheet is taken out and pickled, then is annealed by two-stage annealing. After annealing, it is cooled by a cooling rate controlled to 1° C./hour to 30° C./hour down to 650° C., then is cooled down to room temperature.

The two-stage annealing process is an annealing process holding hot rolled steel sheet in a first stage annealing process in a temperature range of 650° C. to 720° C. for 3 hours to 60 hours and holding it in a second stage annealing process in a temperature range of 725° C. to 790° C. for 3 hours to 50 hours.

Below, the hot rolling process (in particular the finish rolling process) and the coiling process will be explained in detail

[Hot Rolling Process]

When cooling once, then heating the steel slab to use it for hot rolling, the heating temperature is preferably 1000° C. to 1250° C. while the heating time is preferably 0.5 hour to 3 hours. When directly using a steel slab for hot rolling, the steel slab temperature is preferably 1000° C. to 1250° C.

If the steel slab temperature or steel slab heating temperature is over 1250° C. or the steel slab heating time is over 3 hours, there is remarkable decarburization from the surface layer of the steel slab. At the time of heating before hardening, the austenite grains at the surface layer of the steel sheet abnormally grow and the cold formability falls. For this reason, the steel slab temperature or steel slab heating temperature preferably is 1250° C. or less, while the steel slab heating time is preferably 3 hours or less. More preferably it is 1200° C. or less or 2.5 hours or less.

If the steel slab temperature or steel slab heating temperature is less than 1000° C. or the steel slab heating time is less than 0.5 hour, the microsegregation and macrosegregation caused at time of casting are not resolved. Inside the steel slab, regions where Si and Mn and other alloy elements locally concentrate remain and the cold formability falls. For this reason, the steel slab temperature or steel slab heating temperature is preferably 1000° C. or more, while the steel slab heating time is preferably 0.5 hour or more. More preferably it is 1050° C. or more or 1 hour or more.

[Finish Rolling Process in Hot Rolling]

The finish rolling in the hot rolling is ended in a temperature range of 800° C. to 900° C. If the finish temperature is less than 800° C., the steel sheet increases in deformation resistance and the rolling load remarkably rises. Further, the amount of roll wear increases and the productivity falls. For this reason, in the present invention, the finish temperature is made 800° C. or more. Preferably it is 830° C. or more.

If the finish temperature is over 900° C., bulky scale forms while passing through the run out table (ROT). Due to this scale, flaws are formed at the surface of the steel sheet. At the time of cold forming, cracks are formed starting from the flaws. For this reason, the finish temperature is made 900° C. or less. Preferably it is 870° C. or less.

[Temperature Conditions After Finish Rolling to Coiling Process of Hot Rolled Steel Sheet]

When cooling the finish rolled hot rolled steel sheet on the ROT, the cooling rate is preferably 10° C./sec to 100° C./sec. If the cooling rate is less than 10° C./sec, during the cooling, bulky scale is formed. The formation of flaws due to this bulky scale cannot be suppressed, so the cooling rate is preferably 10° C./sec or more. More preferably it is 15° C./sec or more.

If cooling from the surface layer of the steel sheet to the inside by an over 100° C./sec cooling rate, the surface layer part is excessively cooled and bainite, martensite, and other low temperature transformation structures are formed. When paying out the hot rolled steel sheet coil after coiling and cooling to 100° C. to room temperature, microcracks form in the low temperature transformed structure. These microcracks are difficult to remove by pickling. Further, at the time of cold forming, cracks are formed starting from the microcracks. To suppress the formation of bainite, martensite, and other low temperature transformation structures at the surfacemost layer part, the cooling rate is preferably 100° C./sec or less. More preferably it is 90° C./sec or less.

Note that, the cooling rate indicates the cooling ability received from the cooling facilities in a water spray section at the time when being cooled on the ROT down to the target temperature of coiling from the time when the hot rolled steel sheet subjected to finish rolling is water cooled at a water spray section after passing through a non-water spray section. It does not show the average cooling rate from the starting point of water spray to the temperature at which the steel sheet is coiled up by the coiler.

[Coiling Process]

The coiling temperature is made 400° C. to 550° C. If the coiling temperature is less than 400° C., the austenite, which had not yet been transformed before coiling, transforms to hard martensite. At the time of taking out the hot rolled steel sheet coil, cracks form at the surface layer of the hot rolled steel sheet and the cold formability falls. To suppress such transformation, the coiling temperature is made 400° C. or more. Preferably it is 430° C. or more.

If the coiling temperature is over 550° C., pearlite with a large lamellar spacing is produced and high thermal stability bulky needle-shaped carbides are formed. The needle-shaped carbides remain even after two-stage annealing. At the time of cold forming steel sheet, cracks form starting from these needle-shaped carbides, so the coiling temperature is made 550° C. or less. Preferably it is 520° C. or less.

Below, the two-stage annealing process of the method for production of the present invention is explained in further detail The hot rolled steel sheet coil is taken out and pickled, then is held in two temperature ranges as two-stage step type annealing (two-stage annealing). By annealing hot rolled steel sheet by two-stage annealing, it is possible to control the stability of the carbides to promote the formation of carbides at the ferrite grain boundaries and to raise the rate of spheroidization of the carbides at the ferrite grain boundaries. Further, after paying out the hot rolled steel sheet coil, the hot rolled steel sheet is not cold rolled until after the two-stage annealing process and the cooling processes after the two-stage annealing process are completed. Due to the cold rolling, the ferrite grains are refined, the steel sheet becomes harder to soften, and Vicker's hardness of the steel sheet is liable to not become 120 HV to 170 HV.

[First Stage Annealing Process]

The first stage annealing is performed at a temperature range of $A_{C1}$ point or less. Due to this annealing, the carbides are made to coarsen, the alloy elements are made to concentrate, and the carbides are raised in thermal stability. After this, the temperature is raised to the temperature range from the $A_{C1}$ point to $A_3$ point and austenite is made to form in the structure. After that, the steel is gradually cooled to transform the austenite to ferrite and raise the concentration of carbon in the austenite.

Due to gradual cooling, carbon atoms are adsorbed at the carbides remaining in the austenite, carbides and austenite cover the grain boundaries of the ferrite, and, finally, the structure of the steel sheet can be made a structure in which a large number of spheroidized carbides are present at the grain boundaries of the ferrite.

When holding the steel at the temperature range from the $A_{C1}$ point to the $A_3$ point, if there are few residual carbides, during cooling, pearlite and rod-shaped carbides and plate-shaped carbides are formed. If pearlite and rod-shaped carbides and plate-shaped carbides are formed, the cold formability of the steel sheet remarkably falls. Therefore, with holding the steel at the temperature range from the $A_{C1}$ point to the $A_3$ point, increasing the number of residual carbides is important for improving the cold formability.

In the structure of the steel sheet formed in the above-mentioned first stage annealing process, in the temperature range of less than $A_{C1}$ point, thermal stabilization of the carbides is promoted, so by holding the steel at the above-mentioned the temperature range from the $A_{C1}$ point to the $A_3$ point, it is possible to increase the number of residual carbides.

The annealing temperature at the first stage annealing (first stage annealing temperature) is made 650° C. to 720° C. If the first stage annealing temperature is less than 650° C., the carbides are not sufficiently stabilized and, at the time of the second stage annealing, it becomes difficult to make carbides remain in the austenite. Therefore, the first stage annealing temperature is made 650° C. or more. Preferably it is 670° C. or more. On the other hand, if the first stage annealing temperature is over 720° C., austenite is formed before the carbides rise in stability and control of the structure transformation explained above becomes difficult, so the first stage annealing temperature is made 720° C. or less. Preferably it is 700° C. or less.

The annealing time in the first stage annealing (first stage annealing time) is made 3 hours to 60 hours. If the first stage annealing time is less than 3 hours, the carbides are insufficiently stabilized and, at the time of the second stage annealing, it becomes difficult to make carbides remain in the austenite. For this reason, the first stage annealing time is made 3 hours or more. Preferably it is 5 hours or more. On the other hand, if the first stage annealing time is over 60 hours, further stabilization of the carbides cannot be expected and, further, the productivity falls, so the first stage annealing time is made 60 hours or less. Preferably it is 55 hours or less.

[Second Stage Annealing Process]

The annealing temperature of the second stage annealing (second stage annealing temperature) is made 725° C. to 790° C. If the second stage annealing temperature is less than 725° C., the amount of production of austenite is small and the number of carbides at the ferrite grain boundaries (B) falls. For this reason, the second stage annealing temperature is made 725° C. or more. On the other hand, if the second stage annealing temperature is over 790° C., it becomes difficult to make carbides remain in the austenite and the above-mentioned structural transformation becomes difficult to control, so the second stage annealing temperature is made 790° C. or less. Preferably it is 770° C. or less.

The annealing time at the second stage annealing (second stage annealing time) is made 3 hours to 50 hours. If the second stage annealing time is less than 3 hours, the amount of production of austenite is small, carbides are not sufficiently dissolved into the ferrite grains, and the number of carbides at ferrite grain boundaries becomes difficult to increase. For this reason, the second stage annealing time is made 3 hours or more. Preferably it is 6 hours or more. On the other hand, if the second stage annealing time is over 50 hours, it becomes difficult to make carbides remain in the austenite, so the second stage annealing time is made 50 hours or less. Preferably it is 45 hours or less.

After the two-stage annealing, the steel sheet is cooled to 650° C. by a cooling rate controlled to 1° C./hour to 30° C./hour. The austenite produced by the second stage annealing is gradually cooled to be caused to transform to ferrite and carbon is made to be adsorbed at the carbides remaining in the austenite. The slower the cooling rate the more preferable, but if less than 1° C./hour, the time required for cooling increases and the productivity falls, so the cooling rate is made 1° C./hour or more. Preferably it is 5° C./hour or more.

On the other hand, if the cooling rate is over 30° C./hour, austenite transforms to pearlite, the steel sheet increases in hardness, and the cold formability falls, so the cooling rate is made 30° C./hour or less. Preferably it is 26° C./hour or less.

The annealed steel sheet is cooled by the above cooling rate down to 650° C., then is cooled down to room temperature. In the cooling down to room temperature, the cooling rate is not particularly limited.

Further, the first stage annealing and the second stage annealing may be either of box annealing or continuous annealing. Box annealing may be performed using a box type annealing furnace. Further, the atmosphere in the two-stage annealing is particularly not limited to a specific atmosphere. For example, the atmosphere may be an atmosphere of 95% or more nitrogen, an atmosphere of 95% or more hydrogen, or the air atmosphere.

As explained above, according to the method for production of the present invention, it is possible to obtain steel sheet excellent in cold formability and ductility after heat treatment having substantially a structure of grain size 5 μm to 50 μm ferrite and spheroidized carbides, having a ratio (B/A) of the number of carbides at the ferrite grain boundaries (B) to the number of carbides inside the ferrite grains (A) of over 1, and further having a Vicker's hardness of 120 HV to 170 HV.

EXAMPLES

Next, examples of the embodiments is explained, but the conditions in the examples are illustrations employed for confirming the workability and effects of the present invention. The present invention is not limited to these illustrations of conditions. The present invention can employ various conditions so long as not departing from the gist of the present invention and as achieving the object of the present invention.

Example 1

To investigate the effects of the chemical composition, continuously cast slabs (steel slabs) of the chemical compositions shown in Table 1-1 and Table 1-2 (chemical compositions of steel sheets of the present invention) and Table 2-1 and Table 2-2 (chemical compositions of comparative steel sheets) were processed under the following conditions from the hot rolling process to two-stage annealing process to prepare samples for evaluation of characteristics shown in Table 3 (Invention Steels A-1 to Z-1 and Comparative Steels AA-1 to AZ-1). Further, Steel Slabs A to Z in Table 1-1 and Table 1-2 all have chemical compositions of the steel sheet of the present invention. On the other hand, the chemical compositions of the Steel Slabs AA to AZ of Table 2-1 and Table 2-2 were all outside the scope of the chemical composition of steel sheet of the present invention.

TABLE 1-1

| Steel slab | C | Si | Mn | P | S | Al | N | O |
|---|---|---|---|---|---|---|---|---|
| A | 0.16 | 0.43 | 0.86 | 0.0013 | 0.0004 | 0.057 | 0.0036 | |
| B | 0.32 | 0.7 | 0.34 | 0.0069 | 0.0025 | 0.03 | 0.0020 | |
| C | 0.19 | 0.44 | 0.6 | 0.0023 | 0.0026 | 0.069 | 0.0036 | |
| D | 0.24 | 0.56 | 0.35 | 0.0051 | 0.007 | 0.059 | 0.0019 | |
| E | 0.27 | 0.56 | 0.36 | 0.0030 | 0.0005 | 0.024 | 0.0049 | |
| F | 0.19 | 0.73 | 0.79 | 0.0032 | 0.0045 | 0.043 | 0.0008 | |
| G | 0.35 | 0.79 | 0.59 | 0.0017 | 0.0037 | 0.088 | 0.0041 | |
| H | 0.21 | 0.58 | 0.45 | 0.0014 | 0.0067 | 0.093 | 0.0005 | |
| I | 0.18 | 0.75 | 0.48 | 0.0019 | 0.0044 | 0.085 | 0.0041 | |
| J | 0.17 | 0.69 | 0.82 | 0.0039 | 0.0021 | 0.044 | 0.0017 | |
| K | 0.17 | 0.39 | 0.89 | 0.0070 | 0.0012 | 0.088 | 0.0006 | |
| L | 0.33 | 0.53 | 0.75 | 0.0086 | 0.0012 | 0.095 | 0.0039 | |
| M | 0.21 | 0.52 | 0.81 | 0.0023 | 0.002 | 0.011 | 0.0036 | |
| N | 0.32 | 0.71 | 0.72 | 0.0029 | 0.0058 | 0.043 | 0.0013 | 0.0096 |
| O | 0.32 | 0.61 | 0.31 | 0.0091 | 0.0055 | 0.023 | 0.0045 | |
| P | 0.27 | 0.64 | 0.79 | 0.0021 | 0.0018 | 0.044 | 0.0009 | 0.0038 |
| Q | 0.19 | 0.6 | 0.37 | 0.0021 | 0.006 | 0.054 | 0.0002 | |
| R | 0.2 | 0.72 | 0.48 | 0.0001 | 0.0055 | 0.077 | 0.0033 | |
| S | 0.18 | 0.71 | 0.66 | 0.0077 | 0.0048 | 0.025 | 0.0028 | |
| T | 0.22 | 0.37 | 0.94 | 0.0058 | 0.0019 | 0.073 | 0.0029 | |
| U | 0.2 | 0.7 | 0.44 | 0.0050 | 0.0055 | 0.076 | 0.0003 | 0.0097 |
| V | 0.34 | 0.42 | 0.88 | 0.0049 | 0.002 | 0.023 | 0.0011 | |
| W | 0.21 | 0.75 | 0.92 | 0.0010 | 0.0044 | 0.025 | 0.0017 | |
| X | 0.17 | 0.7 | 0.41 | 0.0065 | 0.0068 | 0.056 | 0.0019 | |
| Y | 0.3 | 0.56 | 0.78 | 0.0092 | 0.0027 | 0.047 | 0.0027 | 0.003 |
| Z | 0.23 | 0.64 | 0.37 | 0.0061 | 0.0061 | 0.048 | 0.0010 | |

Units of content of the components of Table 1-1 are mass %.

TABLE 2-1

| Steel slab | C | Si | Mn | P | S | Al | N | O |
|---|---|---|---|---|---|---|---|---|
| AA | 0.18 | 1.5 | 0.51 | 0.0080 | 0.0013 | 0.059 | 0.0027 | |
| AB | 0.8 | 0.59 | 0.79 | 0.0024 | 0.0015 | 0.023 | 0.0002 | |
| AC | 0.32 | 0.61 | 0.74 | 0.0097 | 0.0061 | 0.8 | 0.0009 | |
| AD | 0.36 | 0.5 | 2.2 | 0.0045 | 0.0004 | 0.032 | 0.0002 | |
| AE | 0.32 | 0.15 | 0.37 | 0.0007 | 0.0066 | 0.064 | 0.0031 | |
| AF | 0.16 | 0.61 | 0.81 | 0.0220 | 0.0029 | 0.082 | 0.0033 | |
| AG | 0.23 | 0.6 | 0.72 | 0.0014 | 0.012 | 0.09 | 0.0022 | |
| AH | 0.06 | 0.78 | 0.64 | 0.0017 | 0.0008 | 0.038 | 0.0044 | |
| AI | 0.23 | 0.65 | 0.83 | 0.0029 | 0.0047 | 0.045 | 0.012 | |
| AJ | 0.16 | 0.35 | 0.3 | 0.0019 | 0.0044 | 0.02 | 0.0005 | |
| AK | 0.35 | 0.69 | 0.72 | 0.0029 | 0.0065 | 0.098 | 0.0038 | |
| AL | 0.29 | 0.76 | 0.81 | 0.0020 | 0.0014 | 0.031 | 0.0029 | 0.0002 |
| AM | 0.3 | 0.51 | 0.84 | 0.0001 | 0.0024 | 0.014 | 0.0015 | |
| AN | 0.18 | 0.65 | 0.57 | 0.0081 | 0.0029 | 0.032 | 0.0028 | |
| AO | 0.33 | 0.57 | 0.31 | 0.0086 | 0.0044 | 0.017 | 0.0035 | 0.0062 |
| AP | 0.17 | 0.79 | 0.88 | 0.0033 | 0.0041 | 0.029 | 0.0017 | |
| AQ | 0.31 | 0.42 | 0.53 | 0.0089 | 0.0055 | 0.081 | 0.0033 | |
| AR | 0.29 | 0.45 | 0.82 | 0.0002 | 0.0048 | 0.068 | 0.0008 | |
| AS | 0.29 | 0.67 | 0.77 | 0.0028 | 0.0066 | 0.054 | 0.0039 | 0.0045 |
| AT | 0.27 | 0.49 | 0.69 | 0.0002 | 0.0066 | 0.093 | 0.0016 | 0.02 |
| AU | 0.31 | 0.62 | 0.32 | 0.0047 | 0.0012 | 0.064 | 0.0011 | |
| AV | 0.28 | 0.46 | 0.49 | 0.0064 | 0.0042 | 0.09 | 0.0029 | |
| AW | 0.22 | 0.58 | 0.75 | 0.0095 | 0.0016 | 0.012 | 0.0050 | |
| AX | 0.18 | 0.64 | 0.77 | 0.0033 | 0.006 | 0.058 | 0.0007 | |
| AY | 0.32 | 0.65 | 0.69 | 0.0034 | 0.0057 | 0.066 | 0.0035 | |
| AZ | 0.26 | 0.65 | 0.32 | 0.0044 | 0.0069 | 0.023 | 0.0003 | |

Units of content of the components of Table 2-1 are mass %.

TABLE 1-2

| Steel slab | Ti | Cr | Mo | B | Nb | V | Cu | W | Ta | Ni | Sn | Sb | As | Mg | Ca | Y | Zr | La | Ce |
|---|---|---|---|---|---|---|---|---|---|---|---|---|---|---|---|---|---|---|---|
| A | | | | | | | | | | | | | | | | | | | |
| B | | | | | | | | | | | | | | | | | | | |
| C | | | | | | | | | | | | | | | | | | | |
| D | | | | | | | | | | | | | | | | | | | |
| E | | | | | | | | | | | | | | | | | | | |
| F | | | | | | | | | | | | | | | | | | | |
| G | | | | | | | | | | | | | | | | | | | |
| H | | | | | | | | | | | | | | | | | | | |
| I | | | | | | | | | | | | | | | | | | | |
| J | | | 0.104 | | | 0.011 | | | 0.015 | | | | 0.028 | | | | | | 0.006 |
| K | 0.03 | | | | 0.009 | | | | | | 0.016 | | | | | | | | |
| L | | | | | | 0.04 | | 0.035 | | | | | | | 0.05 | | 0.045 | | |
| M | | 0.007 | | 0.0029 | | | | | | | | | | | | | | 0.021 | |
| N | | | 0.211 | | | 0.042 | | | 0.075 | | | 0.041 | | | | 0.039 | | | |
| O | 0.052 | | | 0.0016 | | | | 0.017 | | | | | 0.015 | | | | | | |
| P | | | | | | | | | 0.081 | | | | | 0.0355 | | | | | |
| Q | | | | | 0.031 | | 0.048 | | | | | | | | | 0.02 | | | |
| R | | | | 0.0019 | | | | | | | | | | 0.0226 | | | | | |
| S | | 0.145 | | | | 0.036 | | | | | | | 0.021 | | | | | 0.023 | |
| T | | | 0.111 | | | | | | | | | 0.035 | | 0.0024 | | | 0.028 | | |
| U | | | | | | | | 0.067 | | | | | | | | 0.042 | | | 0.019 |
| V | 0.032 | | | 0.0022 | | | 0.038 | | | | | | | | | | | | |
| W | | 0.183 | | | 0.002 | | | | 0.042 | | | | | | | | 0.016 | | |
| X | 0.079 | | | | | | | | | | 0.008 | | 0.025 | | | | | | 0.021 |
| Y | | | | | | | | | 0.044 | | | 0.002 | | | | | | | |
| Z | | 0.249 | | | | | | 0.004 | | | | | | | | | 0.031 | | |

Units of content of the components of Table 1-2 are mass %.

TABLE 2-2

| Steel slab | Ti | Cr | Mo | B | Nb | V | Cu | W | Ta | Ni | Sn | Sb | As | Mg | Ca | Y | Zr | La | Ce |
|---|---|---|---|---|---|---|---|---|---|---|---|---|---|---|---|---|---|---|---|
| AA | | | | | | | | | | | | | | | | | | | |
| AB | | | | | | | | | | | | | | | | | | | |
| AC | | | | | | | | | | | | | | | | | | | |
| AD | | | | | | | | | | | | | | | | | | | |
| AE | | | | | | | | | | | | | | | | | | | |
| AF | | | | | | | | | | | | | | | | | | | |
| AG | | | | | | | | | | | | | | | | | | | |
| AH | | | | | | | | | | | | | | | | | | | |
| AI | | | | | | | | | | | | | | | | | | | |
| AJ | | 1.22 | | | | 0.041 | | 0.01 | | | | | | | 0.08 | | | | |
| AK | | | | 0.0013 | | | | | | | | | 0.018 | | | | 0.076 | | |
| AL | | 0.341 | 1.12 | | 0.027 | | | | | 0.067 | | | | | 0.014 | | | 0.026 | |
| AM | | | | | | | | 0.045 | | | | 0.06 | | | | | | | |
| AN | 0.11 | 0.015 | | | 0.11 | | 0.008 | | | | | 0.028 | | | | | | | |
| AO | | | | | 0.022 | | | | | | | | 0.004 | 0.064 | | | 0.014 | | |
| AP | | | | | | | | | 0.11 | | | | | | | | | | |
| AQ | | | | 0.0016 | | | | | | | 0.02 | | | | | 0.072 | | | |
| AR | | | | | 0.043 | | | | | 0.6 | | | | | 0.048 | | | | |
| AS | | | | 0.012 | | | | | | 0.086 | | | 0.034 | | | | 0.013 | | |
| AT | | | | | | | | | | | 0.026 | | 0.055 | | | | | | |
| AU | | | | | 0.035 | | | 0.2 | 0.087 | | | | | | | | | | |
| AV | 0.031 | | 0.197 | | | | | | | | 0.056 | | | | | | | | |
| AW | | 0.134 | | 0.0034 | | | | | 0.088 | | | | | | | | | 0.056 | 0.01 |
| AX | | | | | | | 0.4 | | | | | | | | | | | | |
| AY | | | 0.27 | 0.021 | | | | 0.076 | | | | | | 0.0004 | | | | | 0.063 |
| AZ | | 0.123 | | | | 0.11 | 0.008 | | | | | | | | | | | | 0.014 |

Units of content of the components of Table 2-2 are mass %.

That is, steel slabs of the chemical compositions shown in Tables 1 and 2 were heated at 1240° C. for 1.8 hours, then hot rolled. The finish rolling was completed at a finish temperature of 820° C. After that, the steel sheets were cooled on the ROT by a 45° C./sec cooling rate and were coiled up at the coiling temperature of 510° C. to produce hot rolled steel sheet coils. Next, the hot rolled steel sheet coils were taken out and pickled, then the pickled hot rolled steel sheet coils were loaded into a box type annealing furnace for first stage annealing. The annealing atmosphere was controlled so as to include 95% hydrogen and 5% nitrogen while the coils were heated from room temperature to 705° C. and held there for 36 hours to make the temperature distribution inside the hot rolled steel sheet coils uniform. After that, for second stage annealing, the coils were heated to 760° C., held there for 10 hours, then were cooled down to 650° C. by a 10° C./hour cooling rate, then were furnace cooled down to room temperature to prepare samples for evaluation of characteristics.

The samples were examined for structure and were measured for ferrite grain size and number of carbides by the above-mentioned methods. Next, the samples were loaded into an atmosphere annealing furnace, held at 950° C. for 20 minutes, and, after holding, oil cooled at 50° C. After that, they were tempered so that the hardness became 400 HV. The ductility after heat treatment was found by examining the surfaces of the samples after annealing, preparing sheet thickness 2 mm JIS No. 5 test pieces, and conducting tensile tests at room temperature. The tensile tests were performed with a gauge length of 50 mm and test speeds of 3 mm/min. The result of 10% or more was considered good.

Table 3 shows the ferrite grain size (μm), Vicker's hardness (HV), ratio of the number of carbides at the ferrite grain boundaries to the number of carbides inside the ferrite grains (number of grain boundary carbides/number of grain carbides), and ductility after heat treatment (%).

TABLE 3

| Sample | Steel slab | Ferrite grain size [μm] | Carbide average grain size [μm] | Pearlite area ratio [%] | Vicker's hardness [HV] | No. of carbides at grain boundaries/No. of carbides inside grains | Ductility after heat treatment [%] | Remarks |
|---|---|---|---|---|---|---|---|---|
| A-1 | A | 13.0 | 1.2 | 2.6 | 126 | 3.5 | 12.2 | Inv. steel |
| B-1 | B | 24.3 | 1.0 | 0.5 | 144 | 4.3 | 10.3 | Inv. steel |
| C-1 | C | 16.6 | 1.1 | 0.5 | 126 | 4.5 | 11.7 | Inv. steel |
| D-1 | D | 23.9 | 1.0 | 0.3 | 131 | 3.7 | 11.2 | Inv. steel |
| E-1 | E | 23.4 | 1.0 | 0.3 | 132 | 4.9 | 11.4 | Inv. steel |
| F-1 | F | 13.8 | 1.1 | 2.7 | 146 | 4.8 | 12.4 | Inv. steel |
| G-1 | G | 16.8 | 1.0 | 0.5 | 158 | 3.0 | 10.5 | Inv. steel |
| H-1 | H | 20.2 | 1.0 | 1.0 | 134 | 5.3 | 11.6 | Inv. steel |
| I-1 | I | 19.3 | 1.0 | 2.8 | 143 | 5.5 | 12.7 | Inv. steel |
| J-1 | J | 13.5 | 1.2 | 1.8 | 143 | 4.8 | 12.8 | Inv. steel |
| K-1 | K | 12.7 | 1.2 | 2.8 | 126 | 4.9 | 12.4 | Inv. steel |
| L-1 | L | 14.3 | 1.1 | 0.7 | 143 | 4.2 | 11.0 | Inv. steel |
| M-1 | M | 13.6 | 1.2 | 1.2 | 133 | 4.7 | 11.5 | Inv. steel |
| N-1 | N | 14.7 | 1.1 | 0.8 | 152 | 3.8 | 10.8 | Inv. steel |
| O-1 | O | 25.9 | 1.0 | 1.0 | 138 | 6.3 | 10.5 | Inv. steel |
| P-1 | P | 13.8 | 1.1 | 1.9 | 145 | 6.2 | 11.7 | Inv. steel |

TABLE 3-continued

| Sample | Steel slab | Ferrite grain size [μm] | Carbide average grain size [μm] | Pearlite area ratio [%] | Vicker's hardness [HV] | No. of carbides at grain boundaries/No. of carbides inside grains | Ductility after heat treatment [%] | Remarks |
|---|---|---|---|---|---|---|---|---|
| Q-1 | Q | 23.0 | 1.0 | 0.6 | 130 | 5.5 | 12.3 | Inv. steel |
| R-1 | R | 19.3 | 1.0 | 0.1 | 142 | 3.5 | 12.3 | Inv. steel |
| S-1 | S | 15.5 | 1.1 | 1.0 | 142 | 5.0 | 12.4 | Inv. steel |
| T-1 | T | 12.3 | 1.2 | 1.0 | 127 | 3.1 | 11.5 | Inv. steel |
| U-1 | U | 20.5 | 1.0 | 1.7 | 140 | 3.4 | 12.0 | Inv. steel |
| V-1 | V | 12.8 | 1.2 | 1.4 | 135 | 5.0 | 10.4 | Inv. steel |
| W-1 | W | 12.4 | 1.1 | 1.8 | 150 | 4.3 | 12.0 | Inv. steel |
| X-1 | X | 21.5 | 1.0 | 1.6 | 136 | 3.2 | 12.4 | Inv. steel |
| Y-1 | Y | 13.9 | 1.1 | 2.8 | 142 | 3.6 | 10.8 | Inv. steel |
| Z-1 | Z | 22.7 | 1.0 | 1.5 | 136 | 5.1 | 11.8 | Inv. steel |
| AA-1 | AA | 18.5 | 0.9 | 4.0 | 189 | 4.7 | 11.9 | Comp. steel |
| AB-1 | AB | 13.8 | 1.1 | 9.2 | 178 | 10.6 | 5.6 | Comp. steel |
| AC-1 | AC | 14.4 | 0.9 | 0.6 | 166 | 2.8 | — | Comp. steel |
| AD-1 | AD | 6.9 | 1.4 | 6.0 | 176 | 4.7 | 8.4 | Comp. steel |
| AE-1 | AE | 23.0 | 1.1 | 4.0 | 112 | 4.1 | 8.5 | Comp. steel |
| AF-1 | AF | 13.6 | 1.2 | 0.1 | 138 | 3.7 | 8.5 | Comp. steel |
| AG-1 | AG | 14.7 | 1.1 | 1.9 | 141 | 4.4 | 9.5 | Comp. steel |
| AH-1 | AH | 15.9 | 1.1 | 1.3 | 138 | 3.9 | — | Comp. steel |
| AI-1 | AI | 13.4 | 1.2 | 1.4 | 144 | 5.3 | 8.2 | Comp. steel |
| AJ-1 | AJ | 24.9 | 0.8 | 4.0 | 112 | 4.4 | 9.2 | Comp. steel |
| AK-1 | AK | 14.7 | 1.1 | 2.6 | 154 | 4.8 | 6.5 | Comp. steel |
| AL-1 | AL | 13.2 | 1.1 | 5.0 | 156 | 4.5 | 7.4 | Comp. steel |
| AM-1 | AM | 13.3 | 1.2 | 1.9 | 138 | 3.9 | 6.9 | Comp. steel |
| AN-1 | AN | 17.2 | 1.1 | 1.8 | 145 | 5.3 | 9.0 | Comp. steel |
| AO-1 | AO | 25.9 | 1.0 | 1.3 | 136 | 2.9 | 6.9 | Comp. steel |
| AP-1 | AP | 12.8 | 1.2 | 2.0 | 149 | 3.8 | 9.0 | Comp. steel |
| AQ-1 | AQ | 18.1 | 1.1 | 0.8 | 132 | 3.4 | 7.0 | Comp. steel |
| AR-1 | AR | 13.5 | 1.2 | 1.6 | 136 | 3.9 | 7.1 | Comp. steel |
| AS-1 | AS | 14.1 | 1.1 | 1.5 | 149 | 2.4 | 7.3 | Comp. steel |
| AT-1 | AT | 15.1 | 1.1 | 1.0 | 136 | 3.0 | 8.0 | Comp. steel |
| AU-1 | AU | 25.3 | 1.0 | 1.6 | 139 | 2.8 | 7.4 | Comp. steel |
| AV-1 | AV | 19.0 | 1.1 | 0.2 | 131 | 3.4 | 7.4 | Comp. steel |
| AW-1 | AW | 14.2 | 1.1 | 2.3 | 137 | 2.7 | 8.3 | Comp. steel |
| AX-1 | AX | 14.1 | 1.1 | 2.1 | 140 | 3.4 | 9.0 | Comp. steel |
| AY-1 | AY | 15.1 | 1.1 | 1.0 | 149 | 4.4 | 7.0 | Comp. steel |
| AZ-1 | AZ | 25.2 | 1.0 | 1.5 | 136 | 3.5 | 7.9 | Comp. steel |

As shown in Table 3, in the steel sheets of the present invention (A-1 to Z-1), in each case, the Vicker's hardness was 170 HV or less and the ratio of the number of carbides at the ferrite grain boundaries to the number of carbides inside the ferrite grains (number of grain boundary carbides/number of grain carbides) was over 1. Hardness is an indicator of cold formability, so it is understood the steel sheets of the present invention (A-1 to Z-1) were excellent in cold formability.

As opposed to this, in Comparative Steel sheet AA-1, the amount of Si was large, in Comparative Steel sheet AB-1, the amount of C was large, and in Comparative Steel sheet AD-1, the amount of Mn was large. In each case, the Vicker's hardness was over 170 HV.

In the Comparative Steel sheet AH-1, the amount of C was small and the $A_3$ point was high, so hardening was impossible. In Comparative Steel sheet AE-1, the amount of Si was small and the Vicker's hardness was less than 120 HV. Not only that, the ductility after heat treatment fell. In each of the other comparative steel sheets, the chemical composition was outside the scope of the chemical composition of the steel sheets of the present invention, so the ductility after heat treatment fell.

Example 2

To investigate the effects of the conditions of finish rolling in hot rolling and the coiling process and two-stage annealing process of steel sheet, Test Use Steel sheets A-2 to Z-2 were prepared in the following way. That is, first, Steel Slabs A to Z of the chemical compositions shown in Table 1-1 and Table 1-2 were heated at 1240° C. for 1.8 hours, then hot rolled. The finish rolling of the hot rolling was completed under the conditions shown in Table 4, then the steel sheets were cooled on the ROT by a 45° C./sec cooling rate and were coiled up at the coiling temperature shown in Table 4 to produce sheet thickness 3.0 mm hot rolled steel sheet coils.

Each of the hot rolled steel sheet coils was pickled, then annealed under the annealing conditions shown in Table 4 by two-stage step type box annealing. From the annealed hot rolled steel sheet, a sample of a sheet thickness of 3.0 mm for evaluation of the characteristics was taken and measured for ferrite grain size (μm), Vicker's hardness (HV), ratio of the number of carbides at the ferrite grain boundaries to the number of carbides inside the ferrite grains (number of grain boundary carbides/number of grain carbides), and ductility after heat treatment (%). The results are shown in Table 5.

TABLE 4

| Sample | Steel slab | Hot rolling conditions: Finish hot rolling temp. [° C.] | Hot rolling conditions: Coiling temp. [° C.] | Annealing conditions: 1st stage Holding temp. [° C.] | 1st stage Holding time [hr] | 2nd stage Holding temp. [° C.] | 2nd stage Holding time [hr] | Cooling speed down to 650° C. (° C./hr) | Remarks |
|---|---|---|---|---|---|---|---|---|---|
| A-2 | A | 820 | 510 | 700 | 25 | 760 | 8 | 10 | Inv. steel |
| B-2 | B | 750 | 510 | 700 | 25 | 760 | 6 | 10 | Comp. steel |
| C-2 | C | 880 | 510 | 710 | 25 | 760 | 8 | 5 | Inv. steel |
| D-2 | D | 880 | 650 | 700 | 25 | 760 | 8 | 10 | Comp. steel |
| E-2 | E | 880 | 510 | 600 | 25 | 760 | 8 | 10 | Comp. steel |
| F-2 | F | 880 | 510 | 700 | 25 | 760 | 8 | 10 | Inv. steel |
| G-2 | G | 880 | 510 | 730 | 25 | 760 | 8 | 10 | Comp. steel |
| H-2 | H | 880 | 510 | 700 | 1 | 760 | 8 | 10 | Comp. steel |
| I-2 | I | 880 | 510 | 700 | 25 | 760 | 8 | 10 | Inv. steel |
| J-2 | J | 880 | 510 | 700 | 25 | 720 | 8 | 10 | Comp. steel |
| K-2 | K | 880 | 510 | 700 | 25 | 760 | 1 | 10 | Comp. steel |
| L-2 | L | 880 | 510 | 700 | 25 | 760 | 8 | 10 | Inv. steel |
| M-2 | M | 880 | 510 | 700 | 25 | 760 | 8 | 100 | Comp. steel |
| N-2 | N | 750 | 510 | 700 | 25 | 760 | 8 | 10 | Comp. steel |
| O-2 | O | 880 | 510 | 700 | 25 | 760 | 8 | 10 | Inv. steel |
| P-2 | P | 880 | 510 | 730 | 25 | 760 | 8 | 10 | Comp. steel |
| Q-2 | Q | 880 | 510 | 700 | 1 | 760 | 8 | 10 | Comp. steel |
| R-2 | R | 880 | 510 | 700 | 25 | 760 | 1 | 10 | Comp. steel |
| S-2 | S | 880 | 510 | 700 | 25 | 760 | 8 | 10 | Inv. steel |
| T-2 | T | 880 | 510 | 700 | 25 | 760 | 8 | 100 | Comp. steel |
| U-2 | U | 880 | 650 | 700 | 25 | 760 | 8 | 10 | Comp. steel |
| V-2 | V | 880 | 510 | 700 | 1 | 760 | 8 | 10 | Comp. steel |
| W-2 | W | 880 | 510 | 700 | 25 | 800 | 8 | 10 | Comp. steel |
| X-2 | X | 750 | 510 | 700 | 25 | 760 | 8 | 10 | Comp. steel |
| Y-2 | Y | 880 | 510 | 730 | 25 | 760 | 8 | 10 | Comp. steel |
| Z-2 | Z | 880 | 510 | 700 | 25 | 760 | 8 | 10 | Inv. steel |

As shown in Table 5, in the steel sheets of the present invention, in all cases, the Vickers hardness was 170 HV or less and the ratio of the number of carbides at the ferrite grain boundaries to the number of carbides in the ferrite grains was over 1. Hardness is an indicator of cold formability, so it is understood the steel sheets of the present invention all were excellent in cold formability. Furthermore, the steel sheets of the present invention all had 10% or more ductility after heat treatment, so it is understood they were excellent in ductility after heat treatment.

As opposed to this, in the comparative steel sheets, the manufacturing conditions are outside the scope of the manufacturing conditions of the method for production of the present invention, so the Vicker's hardness rises. Further, in some of the comparative steel sheets, the number of carbides at grain boundaries/number of carbides in grains also fell.

TABLE 5

| Sample | Steel slab | Carbide average grain size [μm] | Pearlite area ratio [%] | Vicker's hardness [HV] | No. of carbides at grain boundaries/No. of carbides inside grains | Ductility after beat treatment [%] | Remarks |
|---|---|---|---|---|---|---|---|
| A-2 | A | 1.04 | 1.2 | 146.4 | 4.23 | 13.0 | Inv. steel |
| B-2 | B | 0.63 | 10.3 | 188.0 | 3.23 | 11.2 | Comp. steel |
| C-2 | C | 1.21 | 0.9 | 140.2 | 3.67 | 13.1 | Inv. steel |
| D-2 | D | 0.63 | 9.2 | 177.6 | 3.22 | 13.3 | Comp. steel |
| E-2 | E | 0.45 | 8.1 | 174.8 | 4.19 | 12.6 | Comp. steel |
| F-2 | F | 1.95 | 0.4 | 164.0 | 7.31 | 13.5 | Inv. steel |
| G-2 | G | 0.60 | 12.3 | 196.1 | 2.20 | 11.2 | Comp. steel |
| H-2 | H | 0.43 | 7.2 | 178.0 | 3.69 | 13.0 | Comp. steel |
| I-2 | I | 0.85 | 2.3 | 155.5 | 4.77 | 13.3 | Inv. steel |
| J-2 | J | 0.35 | 2.1 | 204.5 | 0.88 | 12.6 | Comp. steel |
| K-2 | K | 0.60 | 5.6 | 190.2 | 2.82 | 13.6 | Comp. steel |
| L-2 | L | 0.96 | 1.9 | 159.6 | 4.87 | 11.2 | Inv. steel |
| M-2 | M | 0.56 | 13.5 | 182.4 | 3.09 | 13.1 | Comp. steel |
| N-2 | N | 0.95 | 6.2 | 198.0 | 1.45 | 11.5 | Comp. steel |
| O-2 | O | 0.80 | 0.5 | 146.0 | 4.27 | 11.2 | Inv. steel |
| P-2 | P | 1.11 | 10.2 | 187.3 | 5.10 | 12.3 | Comp. steel |
| Q-2 | Q | 0.82 | 7.8 | 173.8 | 4.52 | 13.4 | Comp. steel |
| R-2 | R | 0.89 | 7.2 | 196.8 | 2.89 | 12.8 | Comp. steel |
| S-2 | S | 0.91 | 2.0 | 158.3 | 2.27 | 13.8 | Inv. steel |
| T-2 | T | 0.59 | 15.3 | 178.4 | 1.74 | 13.3 | Comp. steel |
| U-2 | U | 0.64 | 8.4 | 188.6 | 2.75 | 13.0 | Comp. steel |
| V-2 | V | 1.01 | 6.5 | 188.0 | 3.10 | 10.8 | Comp. steel |

TABLE 5-continued

| Sample | Steel slab | Carbide average grain size [μm] | Pearlite area ratio [%] | Vicker's hardness [HV] | No. of carbides at grain boundaries/No. of carbides inside grains | Ductility after beat treatment [%] | Remarks |
|---|---|---|---|---|---|---|---|
| W-2 | W | 1.30 | 16.2 | 178.0 | 3.11 | 12.9 | Comp. steel |
| X-2 | X | 0.84 | 6.3 | 178.6 | 2.68 | 13.5 | Comp. steel |
| Y-2 | Y | 0.58 | 8.2 | 202.6 | 0.85 | 12.5 | Comp. steel |
| Z-2 | Z | 0.78 | 1.5 | 146.6 | 3.50 | 12.5 | Inv. steel |

INDUSTRIAL APPLICABILITY

As explained above, according to the present invention, it is possible to provide steel sheet excellent in cold formability and ductility after heat treatment and a method for production thereof. Accordingly, the present invention has a high applicability in manufacture of steel sheet and industries utilizing it.

The invention claimed is:

1. A steel sheet comprising, by mass %:

C: 0.10 to 0.40%,
Si: 0.30 to 1.00%,
Mn: 0.30 to 1,00%,
Al: 0.001 to 0.10%,
P: 0,02% or less, and
S: 0.01% or less and
having a balance of Fe and impurities,
wherein a ratio (B/A) of a number of carbides at ferrite grain boundaries (B) with respect to a number of carbides inside ferrite grains (A) is over 1,
wherein a ferrite grain size is 5 μm to 50 μm,
wherein an average grain size of carbides is 0.4 μm to 2.0 μm,
wherein a pearlite area ratio is 6% or less, and
wherein a Vicker's hardness is 120 HV to 170 HV.

2. The steel sheet according to claim 1, wherein said steel sheet further comprises, by mass %, one or more of:

Ti: 0.10% or less,
Cr: 0.50% or less,
Mo: 0.50% or less,
B: 0.01% or less,
Nb: 0.10% or less,
V: 0.10% or less,
Cu: 0.10% or less,
W: 0.10% or less,
Ta: 0.10% or less,
N i: 0.10% or less,
Sn: 0.05% or less,
Sb: 0.05% or less,
As: 0.05% or less,
Mg: 0.05% or less,
Ca: 0.05% or less,
Y: 0.05% or less,
Zr: 0.05% or less,
La: 0.05% or less,
Ce: 0.05% or less,
N: 0.01% or less and
O: 0.02% or less.

3. A method for producing the steel sheet according to claim 1, the method for producing the steel sheet comprising:

(i) hot rolling a steel slab of a chemical composition according to claim 1; finishing the hot rolling in a temperature range of 800° C. to 900° C.; and coiling the hot rolled steel sheet at 400° C. to 550° C.,
(ii) paying out the hot rolled steel sheet; pickling the hot rolled steel sheet; then holding the hot rolled steel sheet in a temperature range of 650° C. to 720° C. for 3 hours to 60 hours as first stage annealing and further holding the hot rolled steel sheet in a temperature range of 725° C. to 790° C. for 3 hours to 50 hours as second stage annealing, and
(iii) cooling the hot rolled steel sheet after annealing, at cooling rate of 1° C./hour to 30° C./hour down to 650° C.; and then cooling the hot rolled steel sheet down to room temperature.

4. The method for producing the steel sheet according to claim 3, wherein that the temperature of the steel slab used for the hot rolling is 1000 to 1250° C.

5. A method for producing the steel sheet according to claim 4, the method for producing the steel sheet comprising:

(i) hot rolling a steel slab of a chemical composition according to claim 4; finishing the hot rolling in a temperature range of 800° C. to 900° C.; and coiling the hot-rolled steel sheet at 400° C. to 550° C.,
(ii) paying out the hot-rolled steel sheet; pickling the hot-rolled steel sheet; then holding the hot-rolled steel sheet in a temperature range of 650° C. to 720° C. for 3 hours to 60 hours as first stage annealing and further holding the hot-rolled steel sheet in a temperature range of 725° C. to 790° C. for 3 hours to 50 hours as second stage annealing, and
(iii) cooling the hot-rolled steel sheet after annealing, at a cooling rate of 1° C./hour to 30° C./hour down to 650° C.; and then cooling the hot-rolled steel sheet down to room temperature.

6. The method for producing the steel sheet according to claim 4, wherein the temperature of the steel slab used for the hot rolling is 1000 to 1250° C.

* * * * *